United States Patent [19]

Salomon

[11] 4,309,833

[45] Jan. 12, 1982

[54] SKI BINDING AND BOOT

[76] Inventor: Georges P. J. Salomon, Le Bordet Quintal, Annecy, France, 74000

[21] Appl. No.: 87,780

[22] Filed: Oct. 24, 1979

[30] Foreign Application Priority Data

Oct. 24, 1978 [FR] France ..... 78 30199

[51] Int. Cl.[3] ..... A43B 5/04; A63C 9/00

[52] U.S. Cl. ..... 36/117; 280/632; 280/615

[58] Field of Search ..... 36/117, 118, 119, 120, 36/121; 280/615, 618, 631, 632

[56] References Cited

U.S. PATENT DOCUMENTS

| | | | |
|---|---|---|---|
| 1,868,386 | 7/1932 | Gresvig | 280/615 |
| 3,612,558 | 10/1971 | Kjellstrom | 280/615 |
| 4,129,319 | 12/1978 | Strohmeier | 36/117 |
| 4,177,584 | 12/1979 | Beyl | 36/117 |

FOREIGN PATENT DOCUMENTS

| | | | |
|---|---|---|---|
| 222828 | 6/1910 | Fed. Rep. of Germany | 36/117 |

*Primary Examiner*—Patrick D. Lawson
*Attorney, Agent, or Firm*—Sandler & Greenblum

[57] ABSTRACT

A ski binding adapted to be used to maintain a boot onto a ski. The binding comprises a latching element adapted to be mounted on the boot which comprises at least one transverse bit. The binding further comprises a support element adapted to be mounted on the ski as well as a retention system which, by virtue of an elastic element, serve to maintain the transverse bit held between the support element and a moveable pressure element of the retention system when the binding is in the locked position. The boot itself comprising the transverse element also forms part of the invention.

41 Claims, 35 Drawing Figures

SKI BINDING AND BOOT

BACKGROUND OF THE INVENTION

1. Field of the Invention

The invention relates to ski bindings used to hold boots onto skis.

2. Description of Prior Art

German Pat. No. 222,828 discloses a ski binding for maintaining one end of a boot onto a ski.

SUMMARY OF THE INVENTION

It is an object of the invention to provide a ski binding which maintains at least one end of the boot on the ski.

It is a further object of the invention to provide a binding which may be used to secure one end of a boot onto a ski while permitting the other end of the boot to be raised off of the ski.

It is yet a further object of the invention to provide a binding which maintains the boot securely fastened to the ski while nevertheless permitting release of the boot when the boot has been subjected to excessive torsion.

These and other objects are fulfiled by means of the binding of the invention which comprises a latching element adapted to be mounted on a boot. The latching element comprises at least one transverse bit. A support element adapted to be mounted on a ski is also provided. The support element comprise a first support zone adapted to pivotably seat the transverse bit. The binding further comprises a retention system for retaining the bit against the first support zone when the boot is inserted in the binding. The retention system comprises a mounting comprising a journalled portion mounted onto the ski and a moveable pressure element journalled on the mounting. The moveable pressure element comprises a second support zone and the first and second support zones are adapted to be positioned on the ski whereby the moveable pressure element is adapted to assume an unlocked position wherein the second support zone is spaced from the first support zone, and is further adapted to assume a locked position wherein the first and second zones hold the bit therebetween. The binding further comprises at least one elastic element positioned to force the second zone towards the first zone when the pressure element is in the locked position.

A boot comprising a latching element for latching the front portion of the boot onto a ski while permitting the heel of said boot to be raised off of the ski is also disclosed. The latching element comprises a transverse bit positioned in front of the boot which is arranged substantially transversely to the boot.

BRIEF DESCRIPTION OF DRAWINGS

With reference to the annexed drawings illustrating the invention by way of example only.

DESCRIPTION OF PREFERRED EMBODIMENTS

Figure 1:
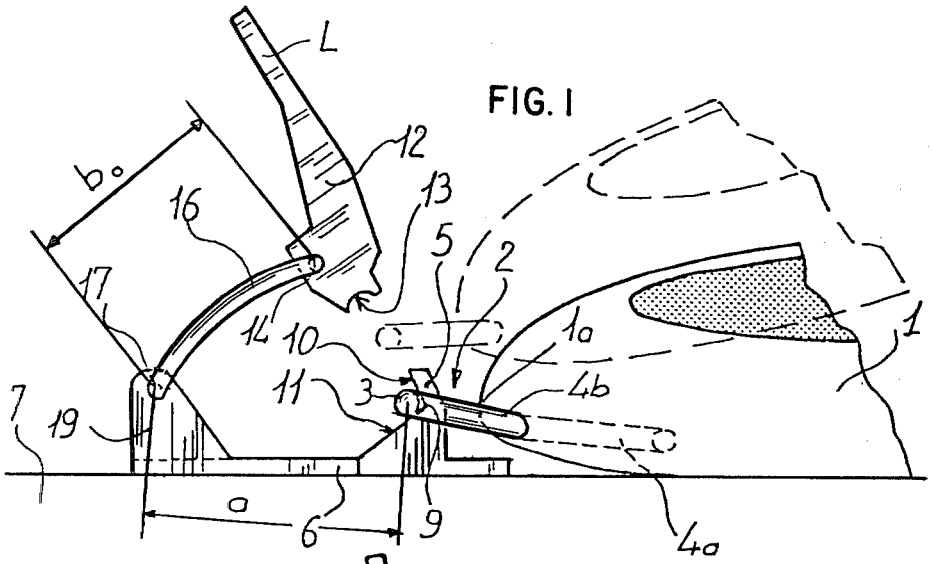
FIG. 1 is an elevational view of a first embodiment of a device according to the invention illustrating insertion of the boot.

While the device of the invention may be also used as one of the elements connecting the front as well as the rear of the boot in the course of downhill skiing, it is nevertheless more particularly adapted, within the context of the present invention, as a binding adapted to connect only the front end of the boot to the ski, the heel of the boot being free to lift off of the ski, as in the case during cross-country or mountaineering skiing (ski de fond and ski de randonnee in French). More particularly, the device of the invention is of the "hinged" type.

According to the invention, the device comprises:

(a) a latching element connected to the boot and extending longitudinally therefrom, the element having at least one bit transverse to the longitudinal axis of the boot and spaced from the end or toe of the boot;

(b) a support element mounted on the ski comprising a first support zone for the transverse bit, the support zone permitting the pivoting of the bit with respect to the support element;

(c) a retention system for the holding the bit against the first support zone, the holding system comprising at least one movable pressure element with respect to the support element having a second support zone for the transverse bit permitting the pivoting of the bit; and (d) at least one elastic element which, when placed under tension, assures the application of the two support zones against the transverse bit to hold the bit there between while allowing for pivoting thereof.

Preferably, and so as to facilitate the construction of the device of the invention, the support element comprising the first support zone is fixed with respect to the ski while, preferably, the elastic element is constituted by a portion of the retention system which is elastically deformable.

It is thus clear that in the case of a binding for a cross-country or mountaineering ski, the latching element is located along an axis extending from the toe and, in held position, the boot being thus jointed or journalled, between the support element and the elastic retention system, around an axis arranged in front of the foot.

Such an arrangement presents numerous advantages. In effect, the skier is able to step with the boot without excessive flexion of the boot at the level of the toes, thus adding an element of comfort. Furthermore, the fact that the junction axis is situated in front of the boot results in the distance traversed in the course of each stride being increased.

Advantageously, the retention system of the invention comprises a mounting journalled to the ski and a moveable pressure element, journalled onto the mounting, and comprising a second support zone adapted to cooperate with the bit of the latching element. The pressure element is adapted to be displaced from an open position in which it is spaced from the first support zone situated on the support element and into a closed position in which its own second support zone is supplied against the bit of the latching element and biased in the direction of the support zone of the support element by virtue of the tensioning of an elastically deformable portion of the retention system.

The two support zones, having essentially complementary shapes, constitute a holder or a portion of a holder having an axis substantially transverse to the longitudinal axis of the ski and in which the transverse bit, which is advantageously of cylindrical cross-section, can pivot.

Furthermore, and according to a preferred aspect of the invention, the mounting and the pressure element constitute a kneecap type locking system which is particularly simple and creates a substantial locking force which tends to strongly direct the bit integral with the boot against the support element. As a result, the foot is well held with respect to torsion, which improves the passage of the ski; the ski remaining perfectly aligned with the boot in the course of use.

According to an advantageous embodiment of the invention, the elastic retention system is situated opposite to the boot with respect to the support zone of the support element; such that, the retention system exerts a force on the bit of the latching element directed substantially towards the rear of the boot.

The elasticity of the retention element may be achieved in various ways. For example, an elastically deformable mounting may be used which may comprise a curved shaft having a U shape whose median element is axled through the pressure element (which can be a rigid element) and whose lateral elements are shaped and adapted to elastically deform along their length. Alternatively, a mounting constituted by jointed but underformable stems may be used, in which case it is a portion of the pressure element which is elastically deformable. In yet another embodiment both the mounting and pressure elements may be elasticlaly deformable.

It will be noted that the transverse bit of the latching element is thus clamped or pinched in an elastic fashion between a support element and a locking element. The elements form a holder between their support zones which is elastically deformable; thus automatically making up for "play" which can exist in the device either by virtue of manufacturing tolerences, or because of wear resulting from continued use.

According to another embodiment of the invention, the support element extends substantially perpendicular to the upper surface of the ski and transversely to the longitudinal axis of the ski while the latching element is in the form of a buckle such that the positioning of the foot prior to locking occurs by a vertical movement from top to bottom of the front of the foot assuring the introduction of the support element in the latching element. As a result, there is no risk of the ski sliding during insertion of the boot.

It should be noted that, preferably, the first support zone provided in the support element may have a recessed or hollow cross-section extending substantially along the entire length of the element. This recess extends upwardly towards and overhang at its top portion. One thus is able to achieve a convenient positioning and guidance of the latching element during insertion of the boot.

In order to further improve the movement of the ski during the course of the stride, according to yet another embodiment of the invention, the invention further provides means (preferably elastic) assuring the maintenance of the front of the ski in contact with the snow, these means communicating to the ski assembly, when the heel is lifted, a rotational moment towards the front.

The construction according to the invention can likewise make possible the realization of a release liberating the skier in the event of excessive torsion.

With reference to the drawings, the first embodiment of the invention is shown in FIGS. 1–5.

The front of the boot generally designated as 1 comprises a latching element 2 comprising cylindrical steel wire having the shape of a buckle or ring (see FIG. 4) whose lateral sides are fixed to the boot, for example, by molding a portion 4*a* of the sides into the boot. The portions 4*b* of the lateral arms of the latching element extend in front of the boot and are connected by a transverse bit 3 which is spaced from the front point 1*a* of the boot and is substantially perpendicular to the longitudinal axis of the boot.

Furthermore, a base plate 6 comprising a support element 5 (which is fixed in all of the examples illustrated) is fixed onto the ski 7 with screws 8. The support element extends above the upper surface of the ski and substantially transversely to the longitudinal axis of the ski.

Figure 4:
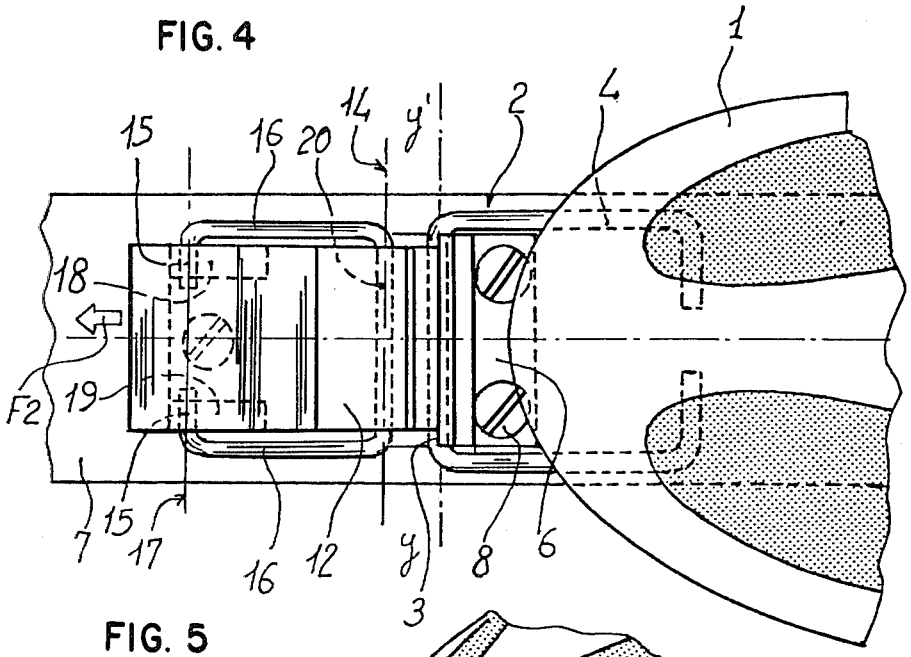
FIG. 4 is a top planer view of FIG. 3.

The surface of the fixed support element which is turned towards the front of the ski (towards the left with reference to FIG. 1) has a first support zone designated in a general fashion as 9 adapted to receive the bit 3 (whose geometrical axis is shown in FIG. 4 as y—y') of the latching element.

In FIG. 1, the support zone 9 comprises two inclined planes 10 and 11 which intersect each other. Plane 10 is inclined forwardly and rearwardly in the direction of the ski while plane 11 is inclined in the direction of the ski from rear to the front. In the embodiment shown, the intersection of the planes 10 and 11 forms an intersection forming a recessed corner which is substantially parallel to the surface of the ski.

It will be noted that the inclined plane 10 constitutes an overhang with respect to the line of intersection of the two planes 10 and 11.

The base plate 6 further comprises, towards the front of the ski, i.e., to the left of the support element 5 as seen in FIG. 1, two vertical lateral walls 18 and 19 adapted to support the retention system of the bit 3 against the fixed support element. The retention system comprises a journalled mounting on the base plate and a movable pressure element journalled on the mounting.

In FIGS. 1–5, the mounting comprises a generally "U" shaped stirrup formed out of a cylindrically-shaped wire. The stirrup has two lateral substantially parallel arms 16 connected by a transverse member 14 on which a pressure element 12 is pivotably mounted. The lateral arms 6 have their free ends 15 curved and engaged in a pivotable fashion in the bores shaving a geometric axis 17 arranged in upstanding walls 18 and 19 of the base plate.

As may be seen in the drawings, the lateral arms 16 are curved in a fashion so as to be concave with respect to the surface of the ski.

The pressure element 12 has a support zone 13 adapted to cooperate with bit 3 of the latching element. This support zone 13 is in the shape of a depression in the form of a cylinder portion having an axis extending substantially transversely to the longitudinal axis of the ski and whose diameter is substantially equal to that of the bit 3. However, the shape of this support zone (as well as that of the fixed support element) can be different as will be seen with reference to FIGS. 7–12 below.

While shape may vary, it is important only that the support zones assure the immobilization of the bit 3 with respect to the ski while permitting the rotation of the bit when the boot is raised and lowered during skiing. The support zone thus act as two separable portions of a holder in which the bit 3 can rotate.

The pressure element 12 comprises, beyond the shaft 14, an extension L serving as a lever for the manipulation of the element.

To assure as perfect holding as possible of the foot, in particular with respect to torsion, the locking of the bit 3 by the support zones (while nevertheless allowing for rotation) is assured by the kneecap device comprising the mounting and the pressure elements. This type of device makes it possible to obtain elevated pressures with simple elastic systems of relatively low energy.

Figure 2:
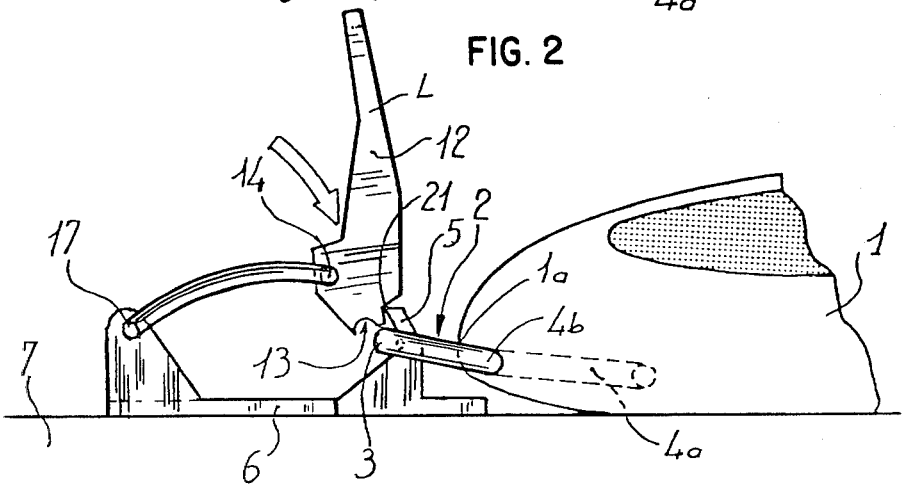
FIG. 2 is an elevational view of the device of FIG. 1 prior to locking the boot in the binding.

The boot is inserted into the binding by engaging the latching element 2 above the fixed support element 5 such that this support element is positioned between the transverse bit 3 and the front 1*a* of the foot (FIG. 1). The pressure element 12, in particular its support zone 13, is then brought adjacent to the bit 3 (FIG. 2). The device is then locked (FIG. 3) by pressing the lever L towards the front in the direction of arrow F.

Figure 3:
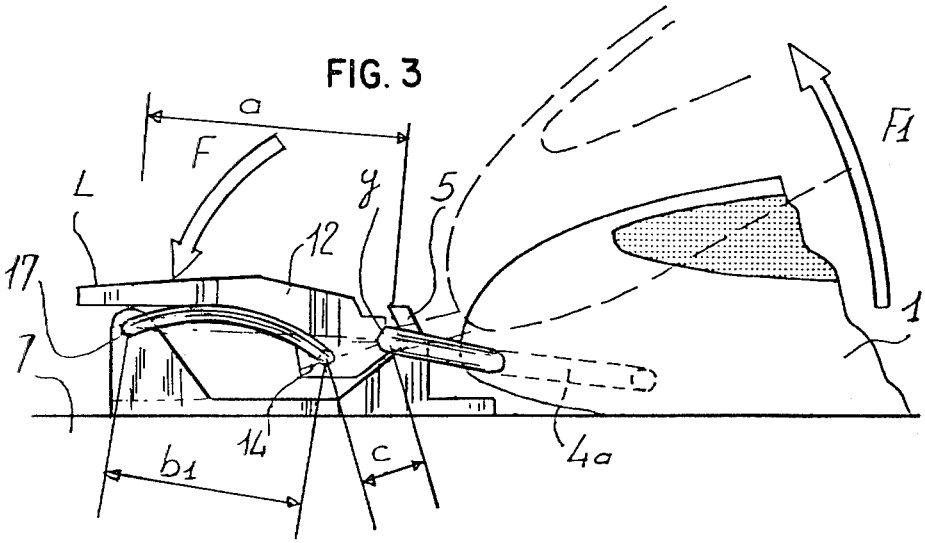
FIG. 3 is an elevational view of the device of FIGS. 1 and 2 in the locked position during skiing.

In the locked position, during skiing, as shown in FIG. 3, the bit 3, integral with the front of the boot is maintained against the fixed support element 5 by the pressure of the pressure element 12. Elements 10, 11 and 13 thus constitute a holder for the bit 3, and the boot can thus pivot around this axis in the direction of the arrow F1 thus permitting cross-country skiing or even mountaineering skiing. The locking system is of the kneecap-type and the distance "a" between the geometrical axis 17 (second axis) and the geometrical axis y—y' (first axis) of the bit 3 is fixed. The distance "c" between the axis 14 (third axis) and the axis y—y' is fixed and the distance "b" between the axes 17 and 14 is elastically variable. In the closed or locked position (FIG. 3), the distance between axes 14 and 17 is "b1" while in the unlocked position (FIG. 1) the distance is "b0", with "b1" being smaller than "b0" and "b0"+"c" greater than "a". The line joining the axis 17 and the axis y—y' is the dead-point line of the kneecap system. During locking, action on the lever L in the direction of the arrow F causes the displacement of the axis 14 from a position where it is situated above the dead-point line (FIG. 2) to a position where it is situated under the dead-point line (FIG. 3). It will be understood that any pressure exerted by the boot on the pressure element will have a tendency to accentuate the elastic force exerted on the bit 3 by the elastic stirrup. The opening of the device necessitates bringing the shaft 14 above the dead-point line, for example, by raising the lever L.

It will be noted that in order to facilitate the locking operation, and particularly the positioning of the pressure element with respect to the fixed pressure element 5, a cut-out 21 is provided just above the support zone 13 of the pressure element. This cut-out is adapted to come into engagement with the upper edge of the fixed support element 5 which thus plays the role of a point of support and reference to provide additional leverage.

Figure 5:
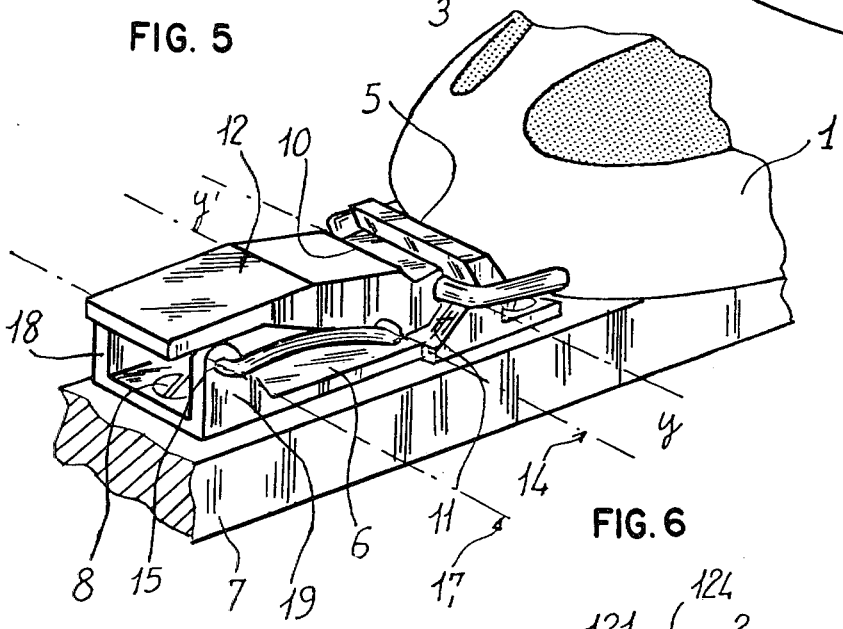
FIG. 5 is a perspective view of the assembly shown in FIG. 3 in the locked position.

FIG. 5 illustrates the invention with the pressure element 12 locked in place.

Figure 6:
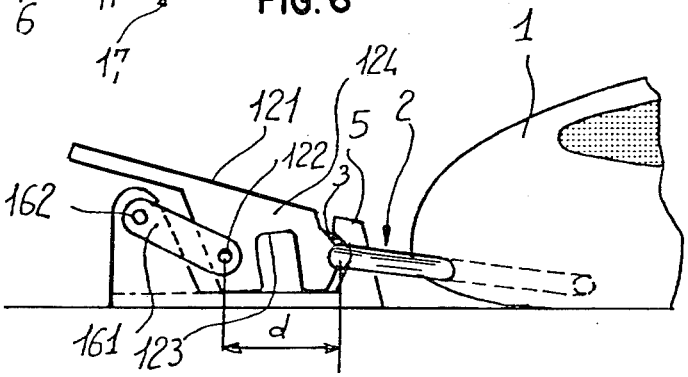
FIG. 6 illustrates a second embodiment of the invention.

FIG. 6 illustrates an alternative embodiment of the kneecap device.

In this embodiment, the mounting comprises two rigid connecting stems 161 journalled to the base plate at 162 while the pressure element 121 journalled at 122 on the connecting stems is elastic such that the distance "d" separating the geometrical axis of the bit 3 from the axis 122 is elastically variable. This can be achieved for example, by providing a depression 123 in the pressure element between the axis 122 and the support zone cooperating with the bit 3 such that the portion 124 of the pressure element has sufficient flexibility.

Figure 7:
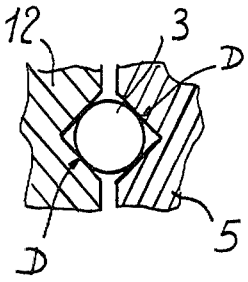
FIGS. 7–12 are partial cross-sectional view, at magnified scale, of the different forms which may be assumed by the support zones between which the bit of the latching element is clamped.

FIGS. 7–12 illustrate several forms which may be assumed by the support zones 9 and 13 adapted to form the holder for the bit 3. In FIG. 7, the two zones have a dihedral hollowed shape and are respectively formed by two secant planes forming a holder having a square cross-section (when the bit is not inserted therein).

Figure 8:
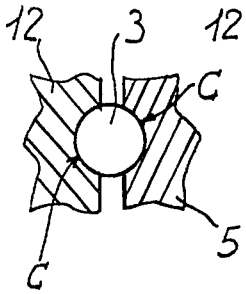

As shown in FIG. 8, the zones each have a cylindrical hollow C thus constituting a substantially circular cross-sectioned holder.

Figure 9:
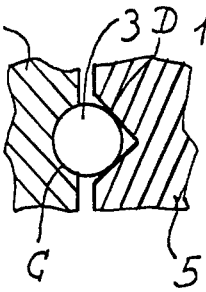

In FIG. 9, one of the zones is hollowed out in the form of a portion of a cylinder C and the other has a hollow shape D comprising two secant planes as is the case for both zones in FIG. 7.

In FIG. 8 both support zones are hollowed out in the form of a cylinder portion.

Figure 10:
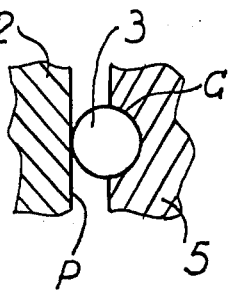

In FIG. 10, a zone C is hollowed out (in the form of a cylinder in the example illustrated) while the other support zone comprises a simple plane P tangent to the bit 3.

Figure 11:
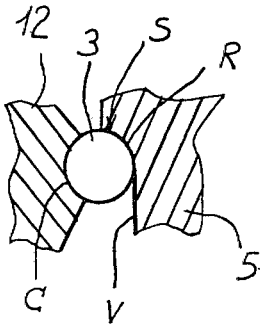

In FIG. 11, the support zone has a hollow cross-section C having a cylindrical shape while the other support zone (belonging to the fixed-support element) is constituted by a vertical plane V extending at its upper portion into an overhand or shoulder S joined to the plane V by a curved section R.

Figure 12:
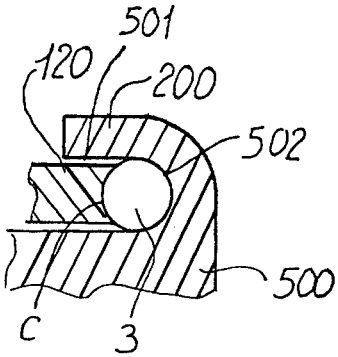

As shown in FIG. 12, the shape of the fixed support element 500 has been modified so as to have a slit 501 substantially parallel to the plane of the ski and has a semi-cylindrical hollow space at its end. The height of the slit 501 and the diameter of the end 502 are equal to or slightly greater than the diameter of the bit 3.

As a result, a projection 200 encloses the top of the holder and prevents any vertical displacement of the bit 3 when it is in place as shown in FIG. 12. The pressure element is likewise appropriately adapted in shape, i.e., its end 120 has a thickness less than the height of the slit 501 so as to be able to engage itself within the slit and its terminal support zone has hollowed out portion C having the shape of a portion of a cylinder.

All of the embodiments according to FIGS. 1–12 permit escape of the foot when the foot is subjected to an excessive torsional force.

In effect, during excessive torsion, the pressure element 12, by virtue of the elasticity of the elements 15 and 16 of the mounting, moves towards the front of the ski in the direction of the arrow F2 (FIG. 4) by virtue of the action of the bit 3 integral with the shoe exercising a pressure having one component which will be parallel to the plane of the ski and directed towards the front of the ski. Thus, the bit 3 spaces itself from the support element and is displaced upwardly.

Figure 13:
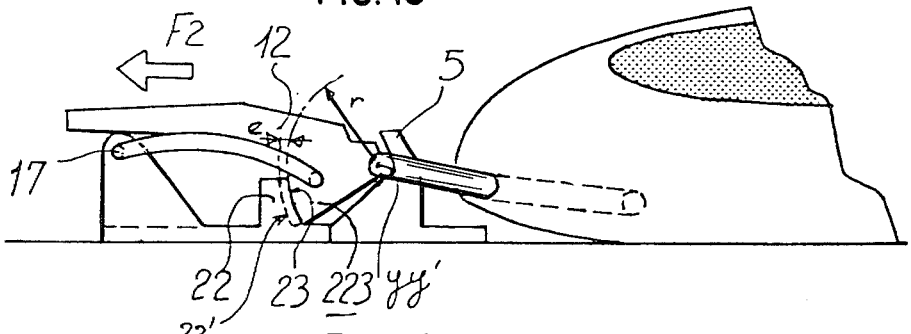
FIG. 13 is an elevational view of a third embodiment of the invention.

With reference to FIG. 13, the pressure element 12 is entirely prevented from moving to the front of the ski in the direction of arrow F2, by virtue of the upstanding projection 22, integral with the base plate and having for example a surface 23 which is substantially vertical or in the form of a curve centered around geometric axis y—y' and having a radius r so as to permit the passage of the element 12 during insertion of the boot into the binding.

Naturally, the element 12 has a lower nose 223 having a shape complementary to fit that of the surface 23 of the projection 22 against which it abuts when in the locked position.

In other words, in the event the surface 23 is curved as shown, the nose has a contoured surface of the same radius of curvature and having the same center of curvature as the surface 23. It will be noted that in the example shown, the projection 22 is situated between the upstanding flanges of the base plate carrying the shaft 17 and the fixed support element 5.

As shown in the embodiment of FIG. 13, a clearance "e" may be provided between the convex surface of the nose 223 and the concave surface 23 (in dashed lines) of projection 22. This clearance "e" allows for a slight elastic displacement of the element 12 in the direction of the arrow F2. The displacement is, however, insufficient to permit the liberation of the transverse bit of the latching element integral with the boot.

Figure 14:
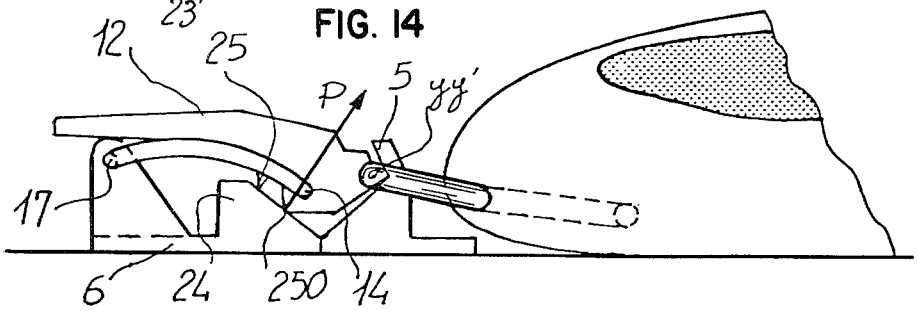
FIG. 14 is an elevational view of a fourth embodiment of the invention.
Figure 15:
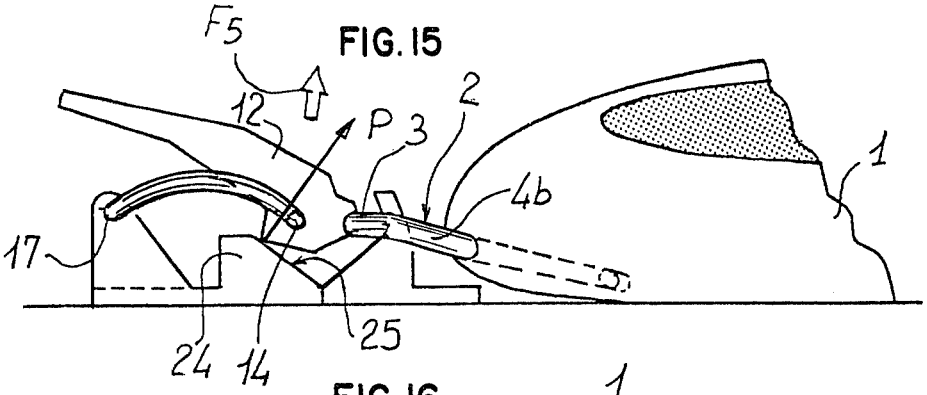
FIG. 15 illustrates the device of FIG. 14 in a different position of use.
Figure 16:
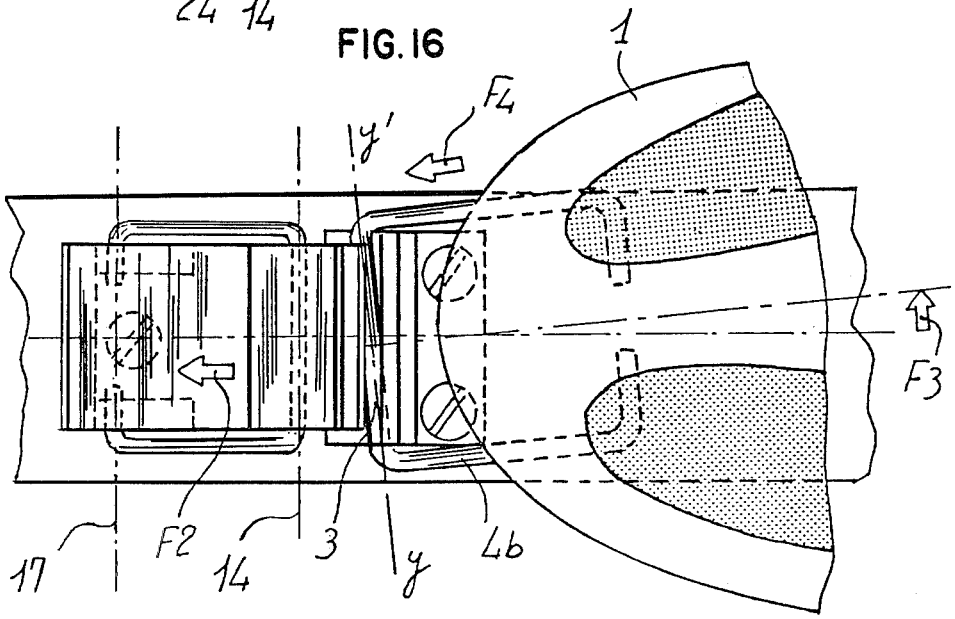
FIG. 16 is a top planar view of the device shown in FIG. 15.

In the embodiment shown in FIGS. 14, 15 and 16, a projection 24 integral with the base plate 6 causes a liberation of the boot while breaking the kneecap lock. To this end, the projection 24 which is situated between the fixed support element 5 and the upstanding walls of the base plate carrying the shaft 17 comprises a release ramp 25 inclined towards the ski (in the direction from the front to the rear of the ski, i.e., from the left to the right when looking at FIG. 14). This ramp 25 serves to support an edge 250 of the pressure element when it is in the locked position.

In this fashion, the action of the ramp 25 on the pressure element when it is in the locked position shown in FIG. 14 is a force in the direction P which is concurrent with the plane defined by the axes 17 and y—y', i.e., that this reaction force has a tendancy to cause the passage of the shaft 14 over the dead point line 17—y—y' when an excessive force is exerted on the element 12 by the bit 3.

The functioning of this device is illustrated with reference to FIGS. 15 and 16.

When the foot is subjected to torsion relative to the ski as illustrated by arrow F3 (FIG. 16), the bit 3 at axis y—y' pivots in the direction of arrow F4 and forces element 12 to move rearwardly in the direction of arrow F2 (FIG. 16). During this rearward motion (FIG. 15), the ramp 25 of the projection 24 acts on the element 12 to which is transmitted a force P which causes, against the reaction of the elastic system, the upward rocking of the element 12 in the direction F5. When the axis 14 passes above the dead point line, i.e., the line connecting axes 17 and y—y', the kneecap device is popped and there is an unlocking and subsequent release of the boot.

Figure 17:
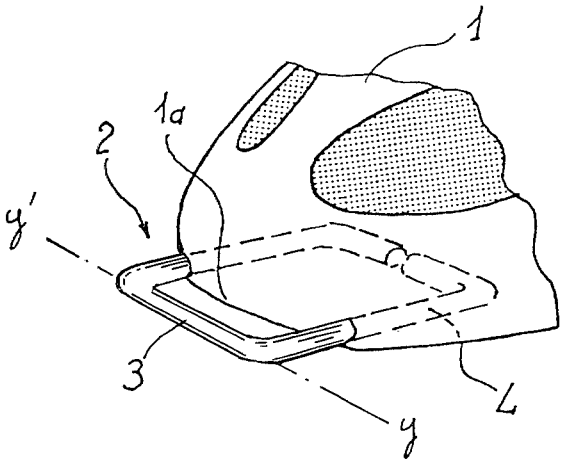
FIG. 17 is a perspective view illustrating the front portion of the boot of FIGS. 1–16.
Figure 18:
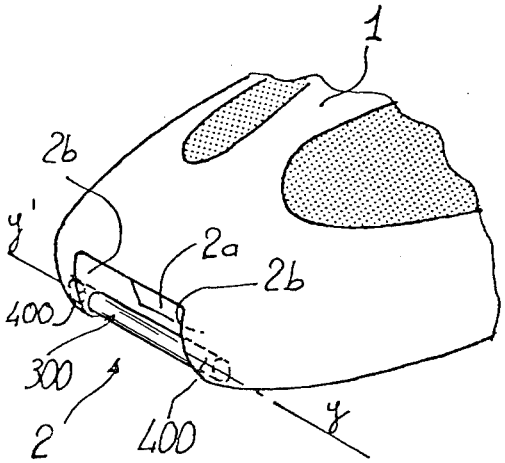
FIG. 18 is a perspective view illustrating another embodiment of the front portion of the boot.

FIG. 17 illustrates, in perspective, the front of a boot equipped with a latching element similar to that shown in FIGS. 1–16. It is obvious that the latching element can assume different forms and particularly such forms as are shown in FIG. 18 where it is seen that the front end **2*a* of the boot is laterally extended in the form of two sidewalls 2*b* defining a median cavity. The ends 400 of a cylindrical shaft 300 whose geometrical axis y—y' is shown are fitted and fixed (for example by molding) in the lateral walls 2*b***.

It is thus seen that when the latching element is characterized as extending in front of the boot that such extension may in effect be integral with the boot.

In the above embodiments, the rotation of the foot around the axis y—y' occurred essentially freely (allowing for friction between the bit and the support zones between which it is held). However, it is most preferred that the rotation of the foot in the direction of the arrow F (FIG. 3) takes place against the action of an elastic device in a fashion so as to give to the ski a moment thus directing the spatula-shaped latch in the direction of the arrow F4 as seen in FIG. 19.

Such a rocking or rotational moment can be generated by various traction means in different ways as discussed below.

Figure 19:
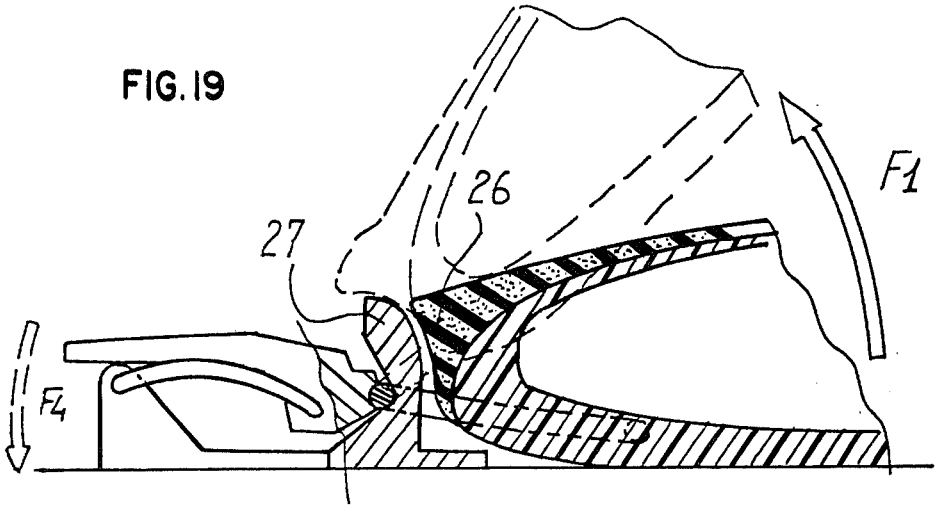
FIG. 19 is a partial cross-sectional elevational view of a fifth embodiment of the device of the invention.

FIG. 19 illustrates a device similar to that of FIGS. 1–5. However, the boot has, at its front portion, an element 26 made out of a flexible material (such as rubber) which, during the rotation of the foot in the direction of the arrow F1, abuts against an integral portion of the ski, for example an extension of the fixed support element whose apex 27 is convex. The front surface of the element 26 may have a slightly concave shape.

Figure 20:
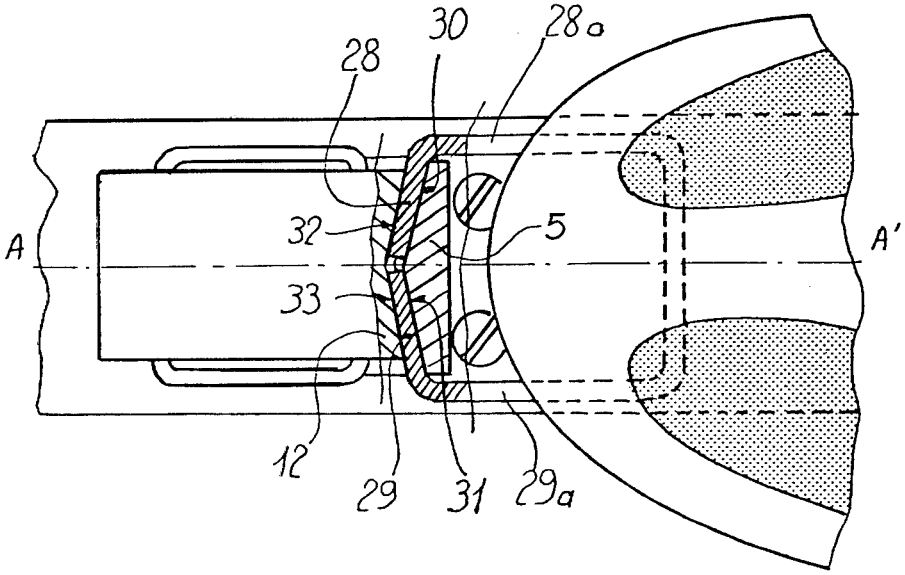
FIG. 20 illustrates a top planer view, in partial cross-section, of a sixth embodiment of the invention.
Figure 21:
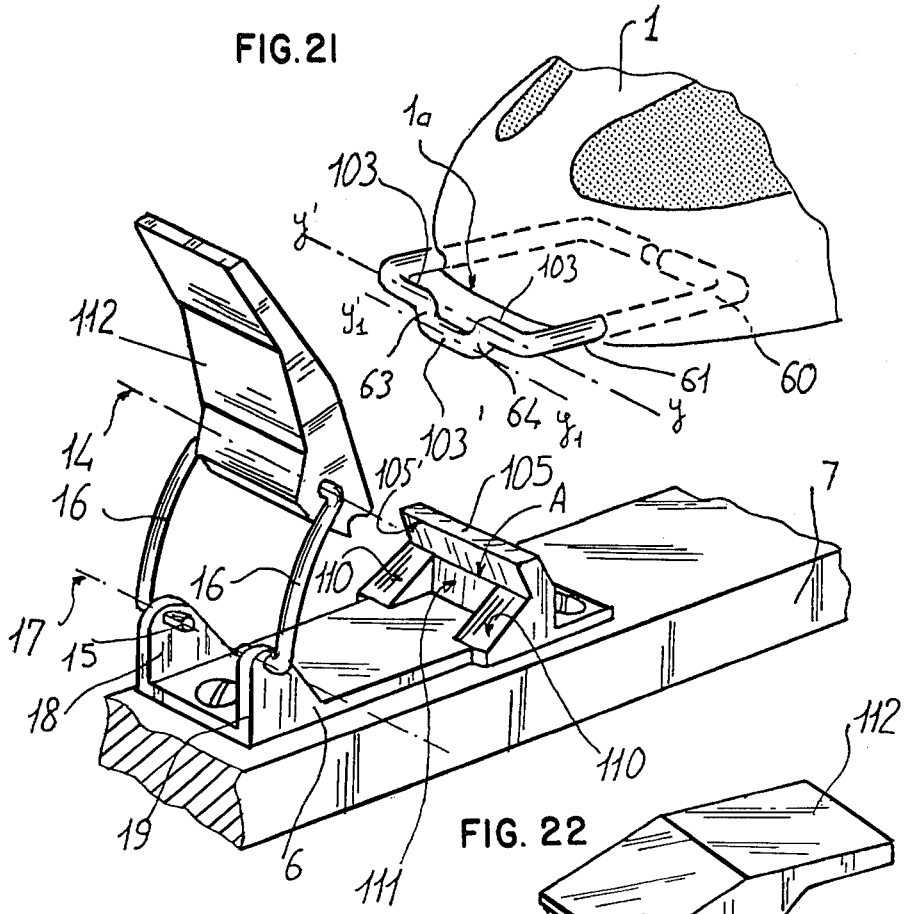
FIG. 21 is a perspective view of the elements of a seventh embodiment of the invention prior to insertion of the boot.
Figure 22:
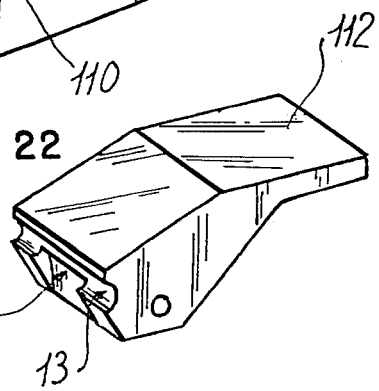
FIG. 22 is a perspective view of the pressure element of FIG. 21.

FIG. 20 illustrates another embodiment of the invention for providing means for transmitting a moment to the ski in which the latching element situated in front of the foot, has two bit portions 28 and 29 respectively terminating in elements **28*a* and 29*a* mounted on the boot. The bit portions 28 and 29 form an angle other than 90 degrees with the longitudinal axis A—A' of the ski and converge symetrically in the direction of the axis A—A'. Furthermore, the fixed support element 5** and the pressure element 12 have support zones respectively comprising two slopes 30 and 31 as well as 32 and 33 converging toward the longitudinal axis A—A' of the ski and which thus form together two holders having intersecting axes on the longitudinal axis of the ski.

It will be understood that when the foot is raised, the pivoting of the latching element causes its deformation which in turn directs the front of the ski downwardly.

FIGS. 21–27 illustrate various embodiments of the invention which are particularly advantageous in which the elasticity of the retention system is used to provide a moment towards the front of the ski.

In FIGS. 21–24, a boot 1 having a latching element on its front comprises a buckle or loop whose lateral arms have a portion 60 embedded in the boot (for example by molding) and a portion 61 extending outwardly from the boot.

The transverse bit connecting the lateral arms is shaped in a fashion so as to form two aligned bit portions of the shaft 103 having a common geometric axis y—y', the median portion of the bit being bent at 63 and 64 to form an activating portion 103' in the form of a cam whose geometric axis y1—y1' is substantially parallel to the axis y—y' and situated beneath it.

In this embodiment, a base plate 6 is screwed onto the ski 7 and comprises two upstanding walls 18 and 19 having bores aligned along a geometrical axis 17 substantially parallel to the ski and transverse to the longitudinal axis of the ski. The arms of a mounting having bent ends 15 are engaged in the bores, in a pivotable fashion. The mounting comprises a cylindrical shaft having a substantially U shape whose lateral arms 16 are elastically deformed in the direction of their length and are arced as in FIGS. 1–5. These lateral arms 16 are joined by a median member along axis 14 around which is mounted in a pivotable fashion a pressure element 112 whose one end has the shape of a manual lever and whose opposite end has a hollow support zone 13 (see FIG. 22) having the shape of a portion of a cylinder (an arc) extending substantially parallel to the plane of the ski and transversely to its longitudinal axis. In the median portion of the support zone, the pressure element has a recessed or cut out section 113 which is adapted to accomodate the cam shaped section 63-64-103' of the latching element of the boot (as is seen particularly in FIG. 23) when the device is in the locked position.

As in the preceeding embodiments, the base plate comprises a fixed support element 105 whose front face faces the upstanding walls 18 and 19 and is constituted by two inclined planes 105' and 110 forming a dihedral whose intersection edge A is transverse to the longitudinal axis of the ski. The lower plane 110 is interrupted as its central portion to provide for a receding vertical wall 111 which serves to accomodate the cam shaped portion 103' in the position shown in FIGS. 23 and 24.

Figure 23:
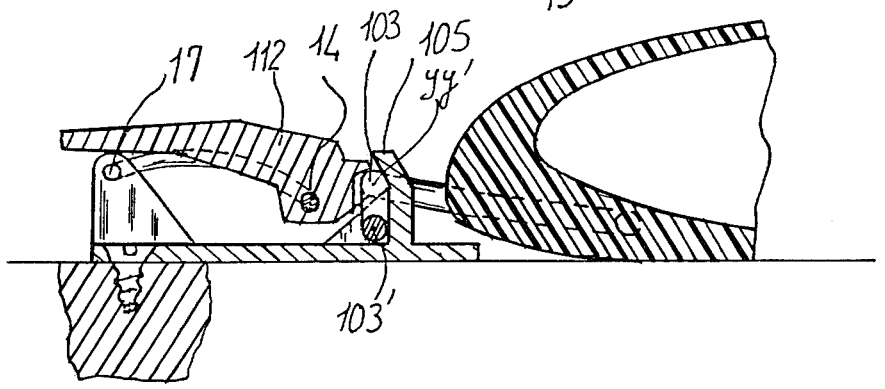
FIG. 23 is a longitudinal cross-sectional view of the device of FIG. 21 in the locked position.

When the boot has been inserted as shown in FIG. 23, the axial bit portions 103 are applied against the support zones 105' and 110 by the pressure element 112 which acts, as in the case of FIGS. 1–5, in the manner of a kneecap, the axis 14 being beneath the dead point line 17—y—y' in the locked position, as has been explained above. Furthermore, the cam 103' is equally supported against the vertical wall 111.

Figure 24:
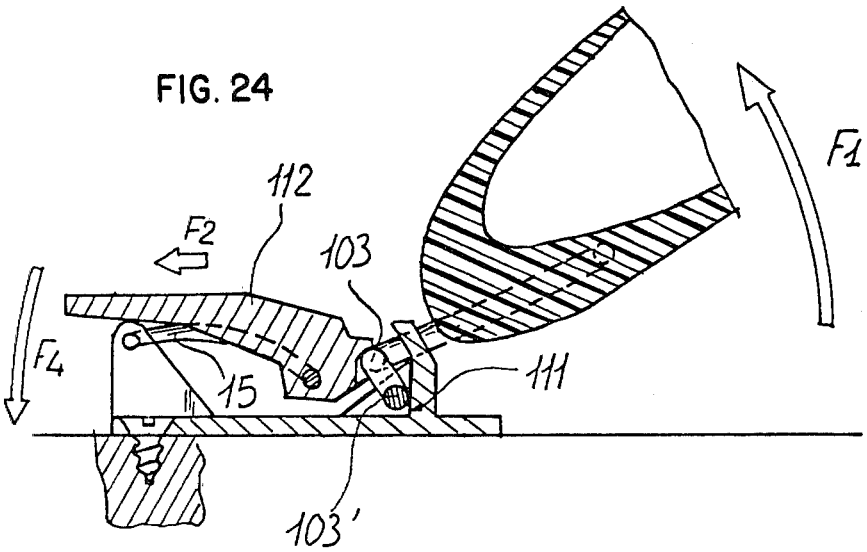
FIG. 24 illustrates the device of FIGS. 21 and 23 with the rear of the boot raised.

During use, i.e., when the skier moves, his foot rises in the direction of the arrow F1 of FIG. 24. In the course of this movement, the handle portion 103' is supported on the surface 111 and the bit 103 thus pushes off the pressure element 112 towards the front, in the direction of the arrow F2, against the elastic action of the arms 16 of the mounting. This rocks the spatula shaped lever of the ski frontwardly in the direction of the arrow F4. In this embodiment, the handle portion 103' can slide along the support surface 111, however this need not be the case, as shown in the embodiment of FIGS. 25, 26, and 27.

Figure 25:
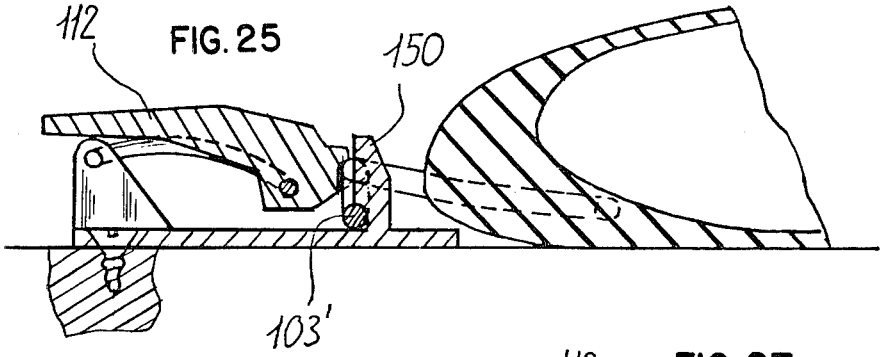
FIG. 25 is a longitudinal view of an eighth embodiment of the invention.
Figure 26:
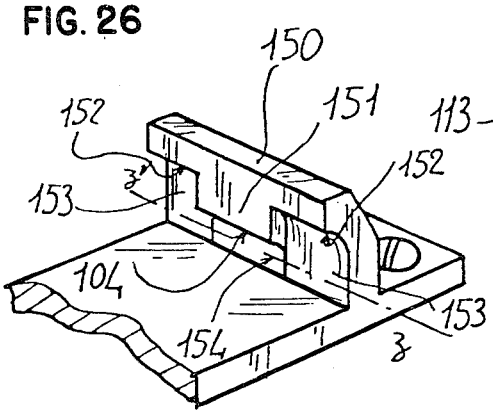
FIGS. 26 and 27 respectively illustrate the shape of the fixed support element in perspective and the position of the elements during operation.
Figure 27:
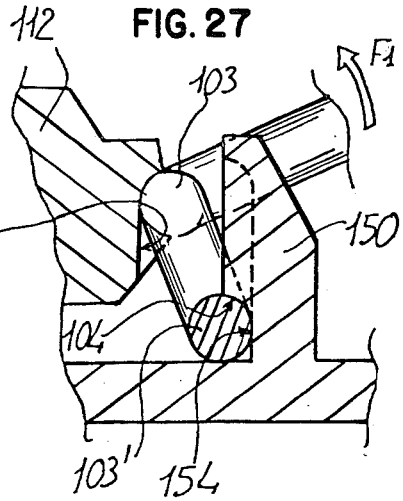

The device of FIGS. 25, 26, and 27 is identical to that of FIGS. 21–24, except insofar as the configuration of the fixed support element 150.

The front surface of support element 150 has a "T" shaped projecting element 151. Each arm of the T is connected by a concave rounded portion 152 to a vertical surface 153. The rounded portions 152 serve as support zones for the portion of the axis 103 of the latching element integral with the boot which is identical to that shown in FIG. 21. Furthermore, under the shank of the T 151 a concave rounded shoulder 104 is provided extending into a vertical wall 154 and serving as seat for the central portion 103' of the cam of the latching element.

During a pivoting of the boot in the direction of the arrow F1 of FIG. 27, the cam 103' will be vertically held by the shoulder 104 which makes rotation around its geometric axis z—z' (FIG. 26).

In the embodiment shown in FIGS. 28–31, the same elements as shown in the preceeding embodiment are again illustrated. However, in these embodiments, the configuration of the transverse bit of the latching element is reversed with respect to that shown in FIG. 21, i.e., that the bent central activation element or cam 203' is situated above the bit portions 203 (whose geometrical axis is identified as y—y') while being parallel to them.

As a result, the plane defined by sections 203 and 203' is substantially perpendicular to the plane of the latching element (defined by the arms of the latching element extending out of and fixed to the boot).

In this embodiment, the fixed support element 205 is likewise different than in the preceeding embodiment. This fixed support element has a median cut-out 206 on its front face 206 bordered on both sides by two lateral projections 207. The cut-out is adapted to receive the cam portion 203' of the latching element. The projections 207 are connected, at their lower portion, to the base plate by curved sections 208 having a common geometric axis y—y', in which are adapted to be lodged, in a pivoting fashion, the bit portions of the axis 203 of the latching element. The radius of these curved sections is substantially equal to that of the portions of the axis 203.

Figure 29:
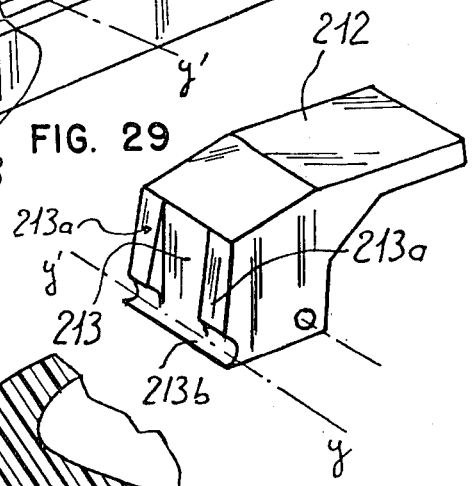
FIGS. 29–31 illustrate detailed views of the various elements shown in FIG. 28.

The pressure element 212 shown in perspective in FIG. 29 is pivotably mounted, as in the preceeding case, on the transverse bit 14 of the elastic mounting comprising a steel wire stirrup whose arms 216 have bent ends pivotably mounted in the bores having a common axis 17 provided in the upstanding walls of the base plate. As in the preceeding cases, the arms 216 are adapted to be elastically deformed along their length. The surface of the pressure element adapted to cooperate with the bit of the latching element has a median planer surface 213 bordered on two sides by two lateral projections **213*a*. The assembly terminates towards the bottom by a rounded hollow portion 213*b* having a geometric axis y—y' and a radius substantially equal to the radius of the axial portions 203** of the latching element.

Figure 30:
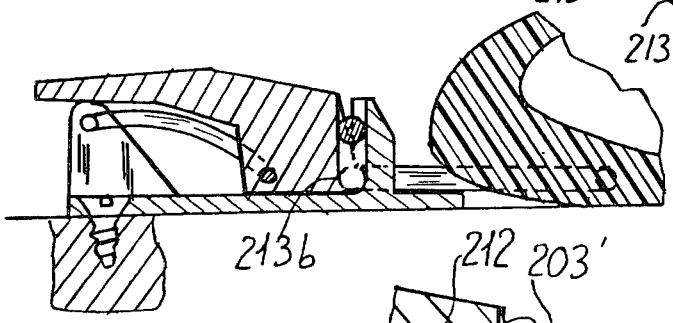

In the locked position of the device shown in FIG. 30, the axial bit portions 203 are held between the curved sections 208 and the hollow portion 213*b*, while the handle 203' is held between the surfaces 206 and 213 by allowing a sufficient space between them.

Figure 31:
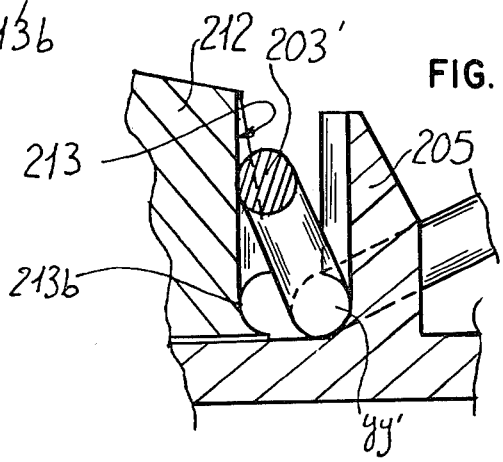

During use, when the boot is raised, the latching element is twisted (see FIG. 31). The portions of the bit 203 pivoting in the curved cut-out 208 which serve as support points and the handle 203' supported on the surface 213, against which it slides, pushes the pressure element 212 back against the action of the elastic mounting.

Figure 32:
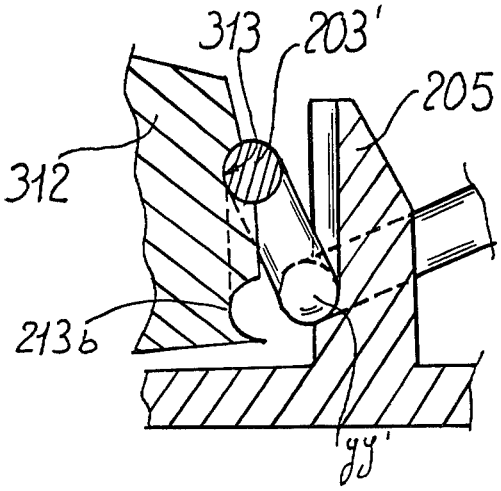
FIG. 32 is a cross-sectional view of another embodiment of the bit of the latching element.

FIG. 32 illustrates an alternative embodiment similar to that of FIGS. 28–31 in which the activating portion (cam) 103' instead of sliding against the surface 213 is engaged against a cylindrically shaped cut-out 313 provided in the median surface of the pressure element. This cut-out 313 extends substantially parallel to the lower cut-out 213*b* accomodating the axial portions 203.

Figure 28:
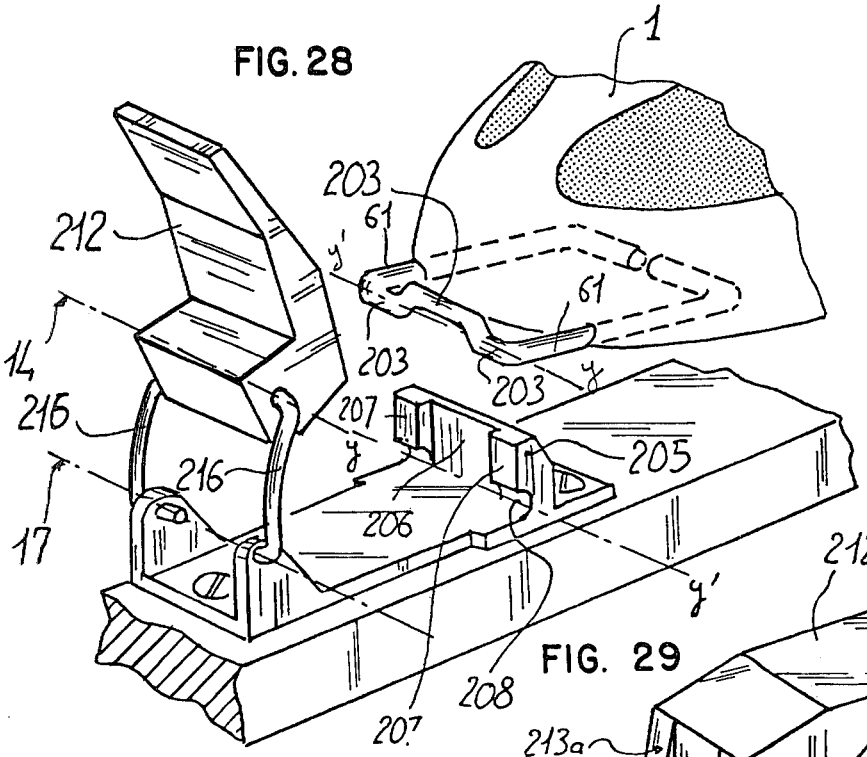
FIG. 28 is a perspective view of the elements of a ninth embodiment of the invention, prior to insertion of the boot.
Figure 33:
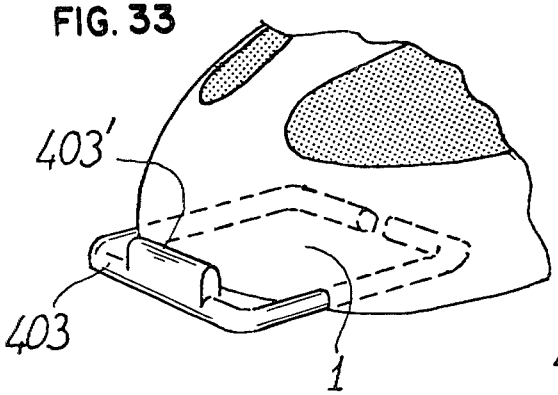
FIGS. 33 and 34 are perspective views respectively illustrating an alternative embodiment of the latching element.

FIG. 33 illustrates yet another embodiment of the front of the boot as shown in FIG. 28 wherein the portion 203', instead of being in the form of a bent cam, is in the form of a simple activating cam 403' having a solid cross-section integral with the median portion of the transverse bit 403 of the latching element. This cam 403' extends towards the top of the boot and substantially perpendicular to the plane defined by the latching element ring. This cam has a greater height from top to bottom than the remained of the latching element.

Figure 34:
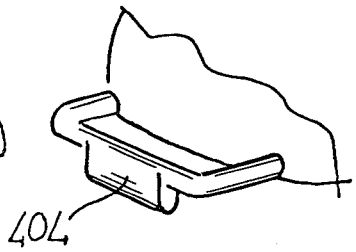

FIG. 34 illustrates the same type of latching element as that of FIG. 33, i.e., with an median-activating cam integral with the transverse bit. However, in this embodiment, the cam 404 extends downwardly under the plane of the ring constituting the activating element.

Figure 35:
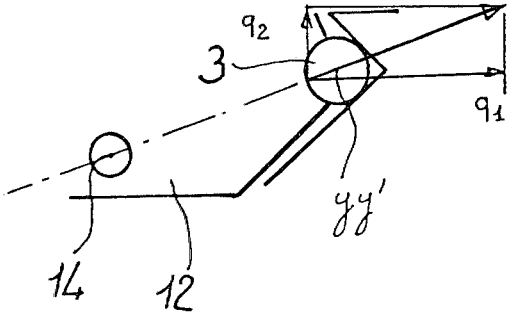
FIG. 35 illustrates a force diagram illustrating how the elastic action of the retention element is exerted on the transverse bit of the latching element.

FIG. 35 is a force diagram illustrating how the elastic action of the pressure element 12 exerts itself on the transverse bit 3 of the latching element.

The elastic action is represented as the force Q, directed towards the rear of the ski and in the direction of the line joining the two axes 14 and y—y'. This force Q therefore has two components, i.e., a horizontal component q1 directed towards the rear and a vertical component q2 directed upwardly.

A rotation (F1) not resulting in a rocking or torsion couple at the beginning of the stride (as in the case of FIGS. 1–18), i.e., not creating a moment on the ski towards the front, but which, results in a rotational moment at the end of the stride, is likewise possible without deporting from the scope of the invention.

The invention is not limited to the specific embodiments disclosed above and extends likewise to embodiments in which the elasticity necessary for holding is obtained by an elastic support element, while the mounting and the pressure elements are rigid.

The invention having been set forth with reference to the detailed embodiments illustrated in the drawings and discussed in the specification, it is understood that the invention is not limited to those embodiments specifically disclosed but extends to all equivalent and substitute materials, elements, and embodiments falling within the scope of the claims.

What is claimed is:

1. A ski binding adapted to be used to maintain a boot on a ski, said binding comprising:

(a) a latching element adapted to be mounted on said boot; said latching element comprising at least one transverse bit;

(b) a support element adapted to be mounted on said ski, said support element comprising a first support zone adapted to pivotably seat said transverse bit;

(c) a retention system for retaining said bit against the first support zone when said boot is inserted in said binding, said retention system comprising a mounting comprising a journalled portion mounted onto said ski, and a moveable pressure element journalled on said mounting, said moveable pressure element comprising a second support zone; said first and second support zones adapted to be positioned on said ski whereby said moveable pressure element is adapted to assume an unlocked position wherein said second support zone is spaced from said first support zone, and is further adapted to assume a locked position wherein said first and second zones hold said bit therebetween; and (d) at least one elastic element positioned to force said second zone towards said first zone when said pressure element is in the locked position.

2. The ski binding as defined by claim 1 in combination with a ski whereby said support element and said retention system are mounted on said ski.

3. The ski binding as defined by claim 2 in combination with a boot, and whereby said latching element is mounted on said boot whereby said transverse bit is spaced from the toe portion of said boot and is positioned substantially transversely to the longitudinal axis of said boot.

4. The ski binding as defined by claim 3 wherein said elastic element is a flexible element forming a portion of said retention system.

5. The ski binding as defined by claim 4 wherein said moveable pressure element constitutes a kneecap-type locking system, and whereby said moveable pressure element is journalled on said mounting along a first axis and said journalled portion of said mounting is journalled along a second axis and wherein said transverse bit is adapted to seat in said first support zone along a third axis and whereby said first axis is adapted to shift above and below a line connecting said second and third axes during locking and unlocking of said binding.

6. The ski binding as defined by claim 5 wherein said retention system is positioned in front of said boot on said ski and whereby said retention system exerts a force on said transverse bit directed substantially towards said boot.

7. The ski binding as defined by claim 6 wherein said first and second support zones form a holder, said holder extending along an axis substantially transverse to the longitudinal axis of the ski, said transverse bit being positioned to be held by said holder when said moveable pressure element is in the locked position.

8. The ski binding as defined by claim 4 wherein at least one of said first and second support zones has a dihedral cross-section.

9. The ski binding as defined by claim 4 wherein at least one of said first and second zones has a cylindrical cross-section.

10. The ski binding as defined by claim 4 wherein said mounting comprises said elastic element.

11. The ski binding as defined by claim 10 wherein said mounting comprises a stirrup shaped element having two lateral arms connected by a transverse member, said moveable pressure element being journalled on said transverse member.

12. The ski binding as defined by claim 11 wherein said mounting further comprises a base plate secured onto said ski and whereby said lateral arms are journalled to said base plate.

13. The ski binding as defined by claim 12 wherein said lateral arms are elastically deformable along their length and constitute said elastic element.

14. The ski binding as defined by any one of claims 4–13 wherein said moveable pressure element is substantially rigid.

15. The ski binding as defined by any one of claims 4–10 wherein said moveable pressure element comprises at least one elastically deformable portion.

16. The ski binding as defined by claim 15 wherein said moveable pressure element comprises an elastically deformable portion constituting said elastic element.

17. The ski binding as defined by claim 16 wherein said mounting comprises at least one connecting stem on which said moveable pressure element is journalled.

18. The ski binding as defined by claim 17 wherein said mounting further comprises a base plate secured onto said ski and said at least one stem is journalled onto said base plate.

19. The ski binding as defined by claim 4 wherein said support element is fixed onto said ski so as to extend substantially perpendicular to the upper surface of said ski and transversally to the logitudinal axis of said ski and wherein the side of said support element facing away from said boot and comprising said first support zone comprises an overhang.

20. The ski binding as defined by claim 19 wherein said side of said support element comprises a lower portion tapering away from the upper surface of said ski.

21. The ski binding as defined by claim 4 wherein said moveable pressure element comprises a lever.

22. The ski binding as defined by claim 4 wherein said ski is a cross-country ski, and said boot is mounted on said ski whereby the heel of said boot may be lifted from said ski.

23. The ski binding as defined by claim 22 further comprising traction means for generating a moment forcing the front of said ski downwardly.

24. The ski binding as defined by claim 23 wherein said traction means for generating said rotational moment comprises a portion of said boot and an abutment element integral with said ski whereby said portion of said boot cooperates with said abutment element when said heel is raised to provide said moment.

25. The ski binding as defined by claim 23 wherein said transverse bit comprises two bit portions each arranged at an angle other than 90 degrees with respect to the longitudinal axis of said ski, said transverse bit and said first and second zones constituting said traction means.

26. The ski binding as defined by claim 23 wherein said transverse bit comprises a cam portion extending along an axis offset from said third axis, and wherein said traction means comprises said cam portion.

27. The ski binding as defined by claim 26 wherein said cam portion comprises a bent portion of said transverse bit.

28. The ski binding as defined by claim 27 wherein said cam portion has a greater length as measured from top to bottom than the remainder of said bit portion.

29. The ski binding as defined by claim 26 wherein said first and second support zones are adapted to hold said transverse bit comprising said cam portion therebetween.

30. The ski binding as defined by claim 29 wherein said cam portion extends along an axis spaced upwardly from said axis of said transverse bit and wherein said moveable pressure element comprises two lateral projections disposed on each side of a median planar surface and a rounded hollow portion extending along the bottom of each of said lateral portions and wherein said support element comprises a median cut-out bordered on each side by a lateral projection, each of said projections having a curved section at its base along a common longitudinal axis.

31. The ski binding as defined by claim 29 wherein said cam portion extends along an axis spaced downwardly from said axis of said transverse bit and wherein said moveable pressure element comprises a cylindrically shaped hollow zone and a recessed median portion and said support element is dihedral having an intersection forming a recessed corner within said first support zone.

32. The ski binding as defined by claim 29 wherein said cam portion extends along an axis spaced downwardly from said axis of said transverse bit and wherein said support element comprises a T shaped projecting element comprising a vertical shank portion and wherein said support element is adapted to receive said cam portion in a seat disposed beneath said shank portion.

33. The ski binding as defined by claim 5 comprising automatic release means for releasing and freeing said boot when said boot is subjected to an excessive force.

34. The ski binding as defined by claim 33 wherein said automatic release means comprises an inclined surface on said support element on which said moveable pressure element rests when in the closed position, and wherein said inclined surface is adapted to direct said first axis above said connecting line when said pressure element is subjected to a pressure whereby said elastic element is sufficiently flexed.

35. A boot comprising a latching element for latching the front portion of said boot onto a ski while permitting the heel of said boot to be raised off of said ski, said latching element comprising a transverse bit positioned in front of said boot and being arranged substantially transversely to the longitudinal axis of said boot, said transverse bit comprising a cam element and two bit portions connected by said cam element, said cam element having a cam surface above said bit portions.

36. A boot comprising a latching element for latching the front portion of said boot onto a ski while permitting the heel of said boot to be raised off of said ski, said latching element comprising a transverse bit positioned in front of said boot and being arranged substantially transversely to the longitudinal axis of said boot, said transverse bit comprising a cam element and two bit portions connected by said cam element, said cam element having a cam surface below said bit portions.

37. A boot comprising a latching element for latching the front portion of said boot onto a ski while permitting the heel of said boot to be raised off of said ski, said latching element comprising a transverse bit positioned in front of said boot and being arranged substantially transverse to the longitudinal axis of said boot, said latching element comprising a ring-shaped element partially molded within said boot.

38. A boot comprising a latching element for latching the front portion of said boot onto a ski while permitting the heel of said boot to be raised off of said ski, said latching element comprising a transverse bit positioned in front of said boot and being arranged substantially transverse to the longitudinal axis of said boot, said latching element consisting of a transverse bit, said transverse bit extending between two side walls extending from said boot.

39. A ski binding adapted to be used to maintain a boot on a ski, said binding comprising:

(a) a latching element adapted to be mounted on said boot, said latching element comprising at least one transverse bit having a cam element;

(b) a support element adapted to be mounted on said ski, said support element comprising a first support zone adapted to pivotably seat said transverse bit;

(c) a retention system for retaining said bit against said first support zone when said boot is inserted in said binding;

said cam element being positioned on said transverse bit to cooperate with said first support zone when the heel of said boot is raised.

40. A ski binding adapted to be used to maintain a ski on a boot, said binding comprising:

(a) a latching element adapted to be mounted on said boot, said latching element comprising at least one transverse bit having a cam portion;

(b) a support element adapted to be mounted on said ski, said support element comprising a first support zone adapted to pivotably seat said transverse bit;

(c) a retention system for retaining said bit against said first support zone when said boot is inserted in said binding, said retention system comprising a movable pressure element comprising a second support zone, said first and second support zones being adapted to be positioned on said ski whereby, in a locked position, said transverse bit is held between said first and second zones, said cam element being positioned to act on said second zone when the heel of said boot is lifted, thereby pivoting said transverse bit.

41. A ski binding adapted to be used to maintain a boot on a ski, said boot comprising a latching element having at least one transverse bit, said binding comprising:

(a) a support element adapted to be mounted on said ski, said support element comprising a first support zone adapted to pivotably seat said transverse bit;

(b) a retention system for retaining said bit against the first support zone when said boot is inserted in said binding, said retention system comprising a mounting comprising a journalled portion mounted onto said ski, and a movable pressure element journalled on said mounting, said movable pressure element comprising a second support zone;

said first and second support zones being adapted to be positioned on said ski whereby said movable pressure element is adapted to assume an unlocked position when said second support zone is spaced from said first support zone, and is further adapted to assume a locked position when said first and second zones hold said bit therebetween; and (c) at least one elastic element positioned to force said second zone against said first zone when said pressure element is in the locked position.

* * * * *

UNITED STATES PATENT AND TRADEMARK OFFICE

CERTIFICATE OF CORRECTION

PATENT NO. : 4,309,833

DATED : January 12, 1982

INVENTOR(S) : Georges Pierre Joseph SALOMON

It is certified that error appears in the above—identified patent and that said Letters Patent is hereby corrected as shown below:

Column 1, line 66, "planer" should be --planar--.

Column 2, line 21, "planer" should be --planar--.

Column 5, line 47, "zone" should be --zones--.

Column 10, line 25, --possible-- should be inserted after "z-z'"; and line 61, "planer" should be --planar--.

Signed and Sealed this

*Thirteenth* Day of *April 1982*

[SEAL]

*Attest:*

GERALD J. MOSSINGHOFF

*Attesting Officer*

*Commissioner of Patents and Trademarks*